US005681178A

United States Patent [19]

Kunkle et al.

[11] Patent Number: 5,681,178

[45] Date of Patent: Oct. 28, 1997

[54] ELECTRICAL CONNECTOR WITH CONNECTOR POSITION ASSURANCE DEVICE

[75] Inventors: John Philip Kunkle, Lancaster; Kathryn Frances Wise, Seven Vallleys, both of Pa.

[73] Assignee: The Whitaker Corporation, Wilmington, Del.

[21] Appl. No.: 495,780

[22] Filed: Jun. 27, 1995

[51] Int. Cl.[6] ..... H01R 13/627

[52] U.S. Cl. ..... 439/352; 439/489

[58] Field of Search ..... 439/352, 353, 439/354, 357, 358, 489

[56] References Cited

U.S. PATENT DOCUMENTS

| | | | |
|---|---|---|---|
| 4,370,013 | 1/1983 | Niitsu et al. | 339/82 |
| 4,634,204 | 1/1987 | Detter et al. | 339/91 R |
| 4,708,413 | 11/1987 | Schroeder | 439/358 |
| 4,711,511 | 12/1987 | Noorily | 439/347 |
| 4,746,306 | 5/1988 | Yurtin et al. | 439/357 |
| 4,946,404 | 8/1990 | Takenouchi et al. | 439/352 |
| 5,026,298 | 6/1991 | Brussalis et al. | 439/358 |
| 5,330,369 | 7/1994 | Nozaki et al. | 439/489 |
| 5,348,493 | 9/1994 | Power | 439/352 |

*Primary Examiner*—Khiem Nguyen
*Assistant Examiner*—Yong Ki Kim

[57] ABSTRACT

An electrical connector assembly (10) includes a connector position assurance device (20), a plug housing (30), and a receptacle housing (40). The connector position assurance device (20) includes a central beam having a central detent (**22*b*) thereon with an end section (22*c*) for engaging a front section (35) of plug housing (30) when the CPA is in a fully advanced position. A web (24) includes a radiused profile (24*a*) for flexing and avoiding damaging stress concentrations in the web (24) when the CPA (20) is in the fully advanced position. Double locking and connector position assurance are achieved, and the CPA (20) can be latched to the plug housing (30) in a pre-engagement position for preventing inadvertent withdrawal of the CPA (20) from the plug housing (30**).

17 Claims, 6 Drawing Sheets

ELECTRICAL CONNECTOR WITH CONNECTOR POSITION ASSURANCE DEVICE

FIELD OF THE INVENTION

The present invention relates to an electrical connector having matable connector halves with a latching mechanism. More particularly, the present invention relates to an electrical connector with a connector position assurance device for indicating to the operator that the matable connector halves have been fully mated together and that the latching mechanism is locked into position.

BACKGROUND OF THE INVENTION

A known electrical connector employing a connector position assurance device (CPA) is disclosed in U.S. Pat. No. 4,746,306. This known electrical connector has dielectric connector bodies which are coupled and locked together by a resilient lock member of one connector body which snaps past and engages a lock member of the other connector body. The resilient lock member includes a slot which extends through one end and a lock shoulder which faces the opposite end thereof. The other lock member includes a lock shoulder and a loop which passes through the slot of the resilient lock member and cooperatively forms a gauge hole of a predetermined size with the resilient lock member when the connector bodies are coupled and locked together by the lock shoulders. A gauge pin having a shank of substantially the same predetermined size is disposed in the gauge hole to indicate that the connector bodies are locked together by the lock shoulders.

This known connector assembly provides a means of indicating that the connector bodies are locked together; however, the gauge pin member is inserted in a direction transverse to the insertion direction of the matable connector bodies which insertion may be difficult in close working areas. Additionally, the gauge pin locking portions are exposed to the environment which creates the potential for the gauge pin to be inadvertently dislodged from its gauge hole. Moreover, the gauge pin cannot be pre-connected to either connector body half prior to connection of the two body halves; consequently, three separate parts must exist prior to connection of the connector bodies.

Another known connector assembly is disclosed in U.S. Pat. No. 4,946,404. This known invention provides for a connector position assurance (CPA) connected to a first matable housing. When the first matable housing is mated to a second matable housing, the flange members of the second matable housing protrude to engage a forwardly extending portion of the CPA. The CPA, at this point, is in a pre-engagement state, so that a portion of the CPA is locked against a portion of the first housing. When the first and second housings are joined together, the extending flange of the second housing engages a portion of the CPA so that the CPA can be pushed towards the second housing and, at the same time, the forwardly extending portion of the CPA will be deflected above the embossments of the second housing and thereby advance to a forward position within the second housing. In this way, the operator can tell that the first and second housings have been fully mated together. However, the invention requires the formation of special embossments on the first housing for engaging the CPA for deflection thereof. Additionally, the forwardly extending portions of the CPA are liable to be damaged or stubbed when the CPA is moved to its final position within the second housing, and the second housing requires formation of special forwardly extending flange members for engagement with the CPA.

Another known electrical connector assembly with a CPA is disclosed in U.S. Pat. No. 4,370,013. The CPA of this connector requires resilient fingers which extend outwardly therefrom but are subject to being damaged during mating or disconnection of the matable connector housings. The CPA of this invention does not show a suitable pre-engagement position between the CPA and the housing it is first mounted on. Therefore, the CPA can be inadvertently dislodged from the first housing. Moreover, when it is desired to remove the first housing from its matable connector half, it is possible that the CPA will be damaged during removal of the CPA.

In light of the foregoing, the present invention seeks to overcome the deficiencies of the prior art by providing a CPA which: is inserted in a direction generally parallel to the insertion direction of the mating connecting half; does not expose its locking surfaces to the outside environment, and therefore the likelihood of inadvertent damage or withdrawal of the CPA is lessened; can be pre-latched to a first housing member prior to engagement with a mating connecting half; does not require the formation of special embossments on the first housing member to which it is connected in the pre-engagement position, and does not require the formation of special extending flanges on the second housing member; is not subject to being stubbed or damaged; provides a way of withdrawing the CPA from the housings after they have been fully mated together so that the CPA is not damaged; provides a substantial double locking means for ensuring that the mated connector halves stay mated together; securely mounts the CPA to the first housing in the pre-engagement position.

DETAILED DESCRIPTION OF THE INVENTION

Figure 1:
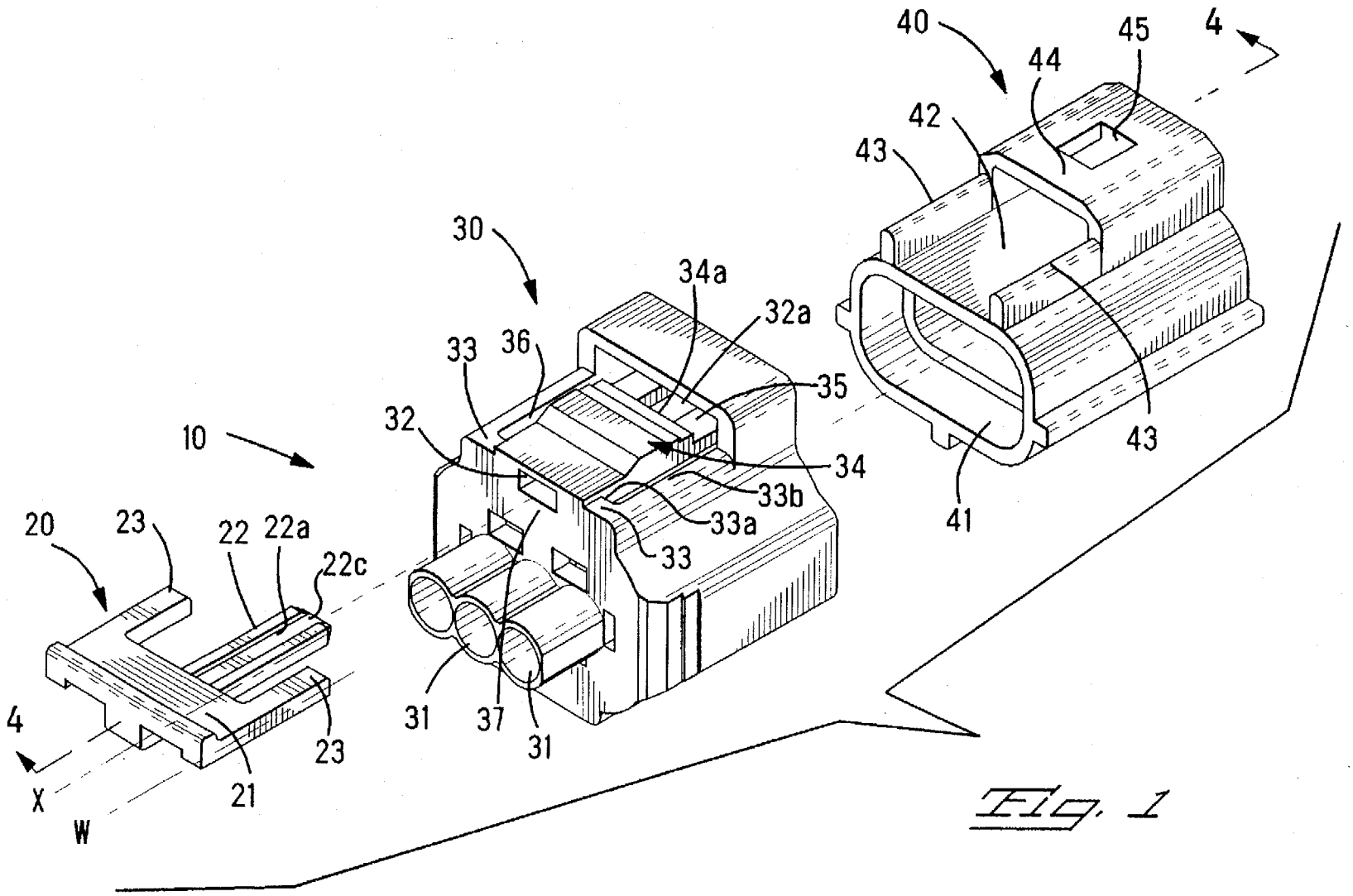
FIG. 1 shows an isometric view of the connector of the present invention in a pre-assembled state.
Figure 2:
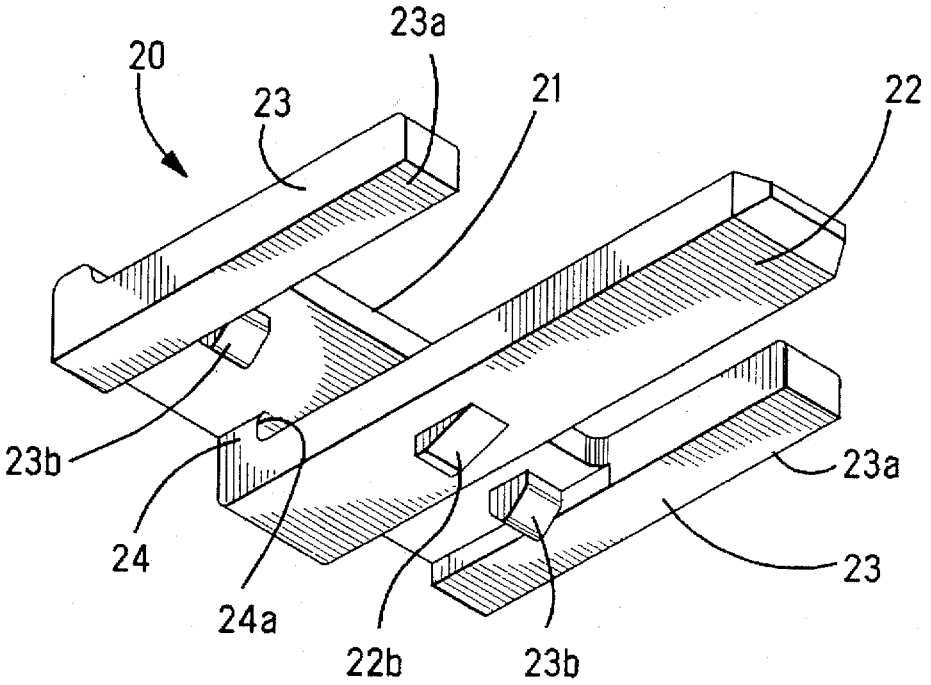
FIG. 2 shows an isometric view of the CPA of FIG. 1.

FIG. 1 shows an electrical connector assembly 10 according to the present invention. Assembly 10 includes a connector position assurance device (CPA) 20, a plug housing 30, and a receptacle housing 40. Referring to FIGS. 1 and 2, CPA 20 includes a body 21 from which a central beam 22 and two collateral beams 23 extend. Central beam 22 includes: a groove **22*a* for regulating the flexure of the beam in the performance of its function as a CPA; a central detent 22*b* on a bottom surface; and an end section 22*c*. Collateral beams 23 each include a flat bottom surface 23*a* and collateral detents 23*b* formed between the collateral beams 23 and the body 21. Central beam 22 is joined to body 21 by a flexible web 24 which includes a radiused profile 24*a***.

Plug housing 30 includes: a set of wire receiving apertures 31; and a central aperture 32 for receiving the central beam 22, and the central aperture 32 includes a beam receiving space 32*a* for receiving the end section 22*c* of central beam 22. Collateral corner sections 33 are provided for receiving the collateral beams 23, edges 33*a* are arranged for locking engagement with collateral detents 23*b*, and runners 33*b* are adapted for supporting flat bottom surfaces 23*a* of collateral beams 23. A centrally located deflectable beam 34 is provided with a stop edge 34*a* for engaging a portion of receptacle housing 40, as will be further described below. Gaps 36 are configured for allowing the deflectable beam 34 the necessary room for deflection. Aperture flange 37 is formed adjacent to central aperture 32 for locking with central detent 22*b* of central beam 22, as will be further described below.

Figure 3:
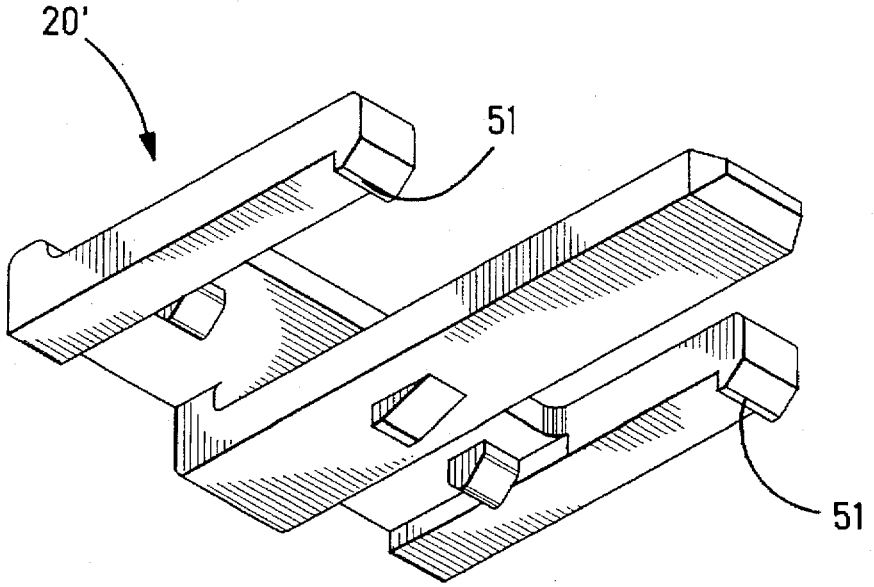
FIG. 3 shows an alternative embodiment of the CPA of FIG. 2.

FIG. 3 shows an alternative embodiment of the CPA 20 in that latch projections 51 are formed on respective ends of collateral beams 23 for the purpose of providing an additional latching means. It is contemplated that the latch projections 51 will rest on runners 33*b* of plug housing 30 when the CPA 20 has been moved to its pre-latched position on the plug housing 30, thereby preventing CPA 20 from being dislodged prior to assembly.

Referring again to FIG. 1, receptacle housing 40 includes a plug housing receiving aperture 41, a trough 42, walls 43, tapered rail 44, and a latch aperture 45. The trough 42 and walls 43 are sized to receive the deflectable beam 34 of plug housing 30, and the walls 43 should slidingly fit into respective gaps 36 of plug housing 30. FIG. 1 shows two axes: a W axis which is aligned with the longitudinal axis of the collateral beam 23; and an X axis which is aligned with the longitudinal axis of the central beam 22. These axes are shown as essentially parallel relative to each other in FIG. 1, but will be offset when the CPA is in its fully advanced position, as will be described below.

Figure 4:
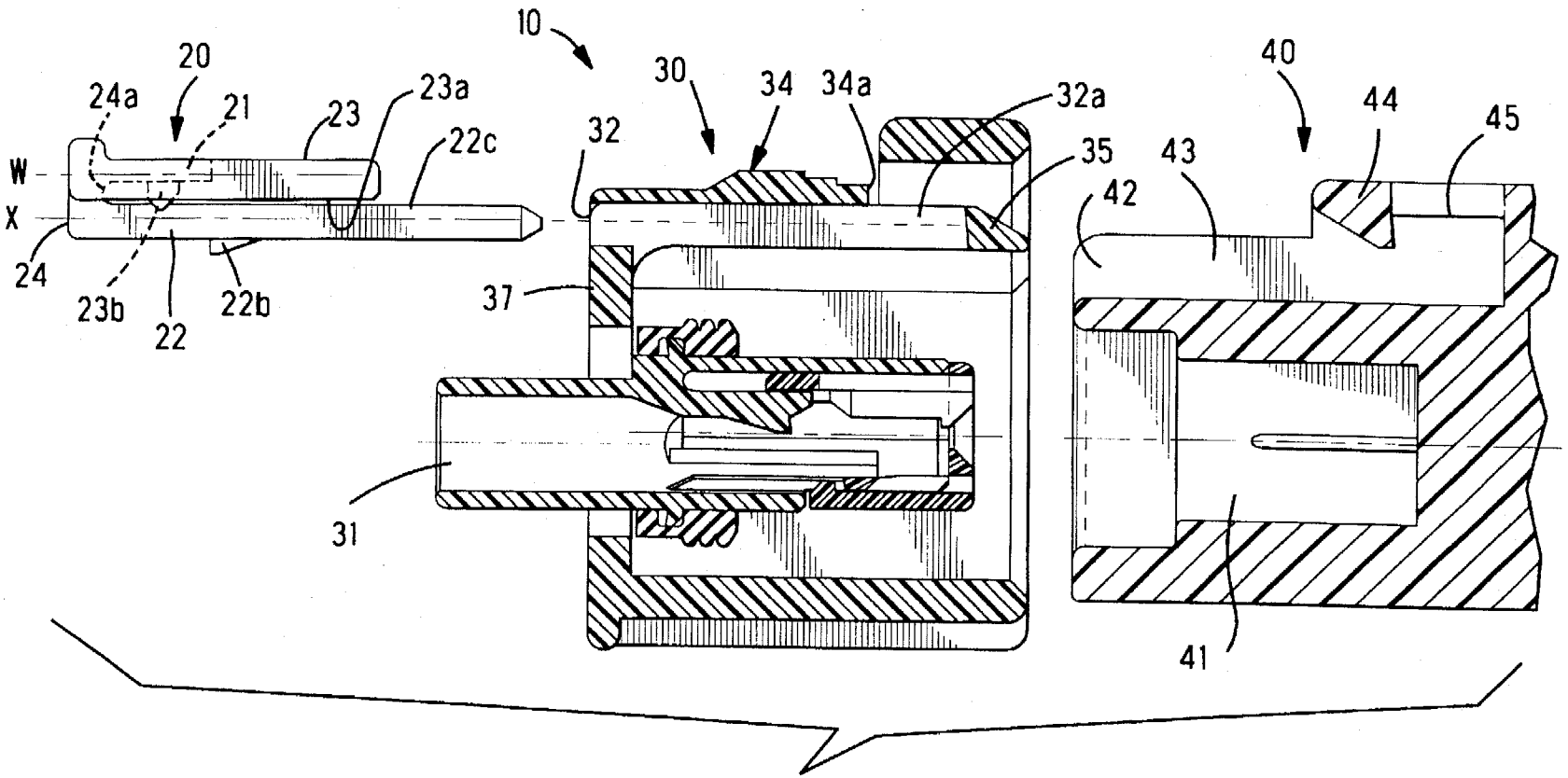
FIG. 4 shows a side cross sectional view of the assembly of FIG. 1.

FIG. 4 best shows some of the details of the assembly of FIG. 1. For example, the front section of deflectable beam 34 is a tapered end 35 aligned for sliding engagement with the tapered rail 44 of receptacle housing 40 when the plug and receptacle housing 30,40 are mated together. The deflectable beam 34 will resile downwardly upon engagement with the tapered rail 44.

Figure 5:
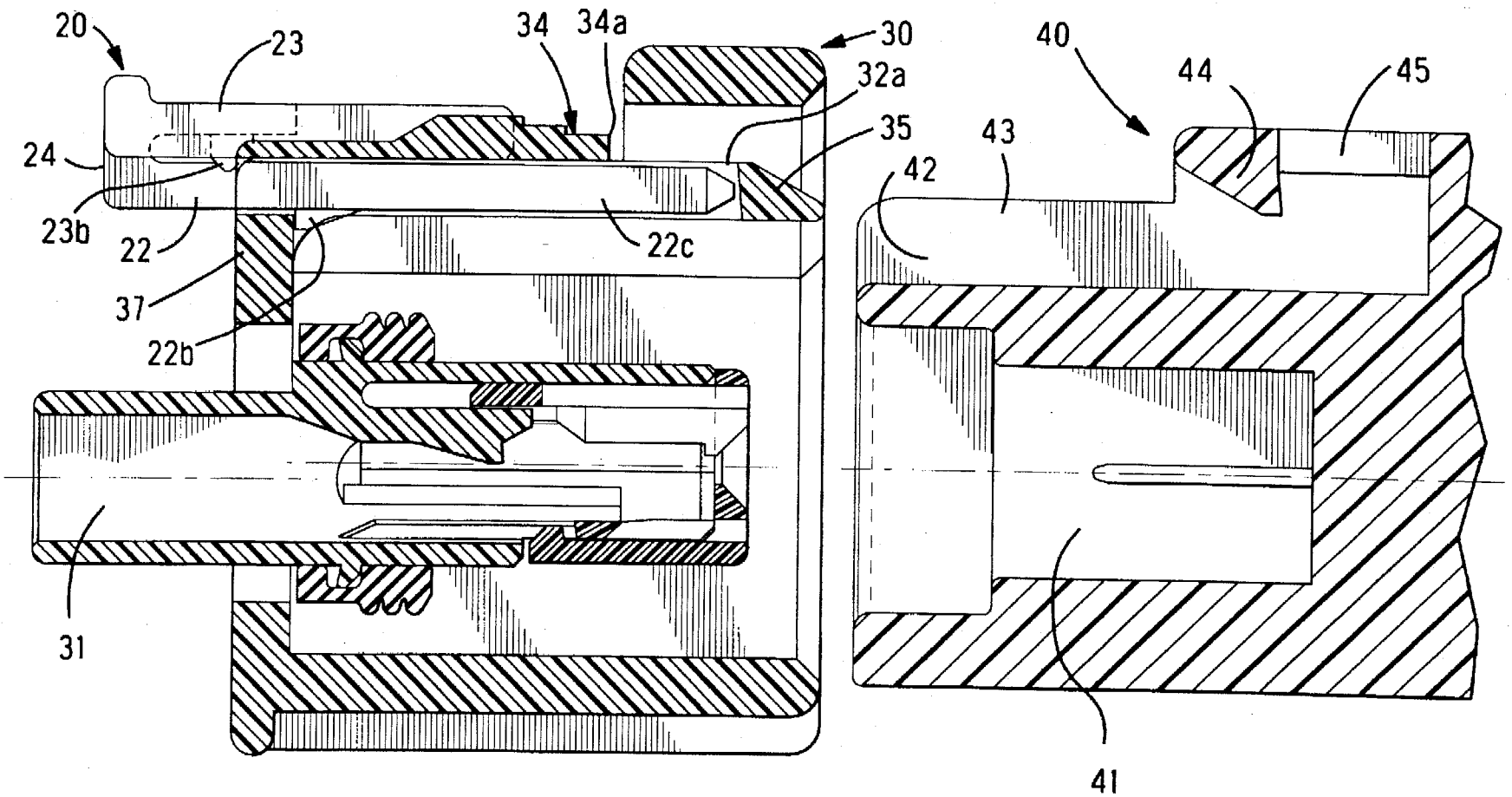
FIG. 5 shows the CPA of the present invention installed on a plug housing.

FIG. 5 shows the CPA 20 in a pre-latched position so that the central detent 22*b* of central beam 22 has passed beyond aperture flange 37 and is engaged therewith. Additionally, the end section 22*c* of central beam 22 is in engagement with front section 35 of beam 34 thereby latching the CPA to the plug housing and retaining it there prior to full mating of the plug housing with the receptacle housing 40. Moreover, CPA 20 cannot be advanced unless and until the front section 35 has been deflected around tapered rail 44. In this position, the bottoms 23*a* of collateral beams 23 are resting on runners 33*b* of collateral corner sections 33 of plug housing 30, and the collateral detents 23*b* of collateral beams 23 are in engagement with the collateral corner sections 33 of plug housing 30.

Figure 6:
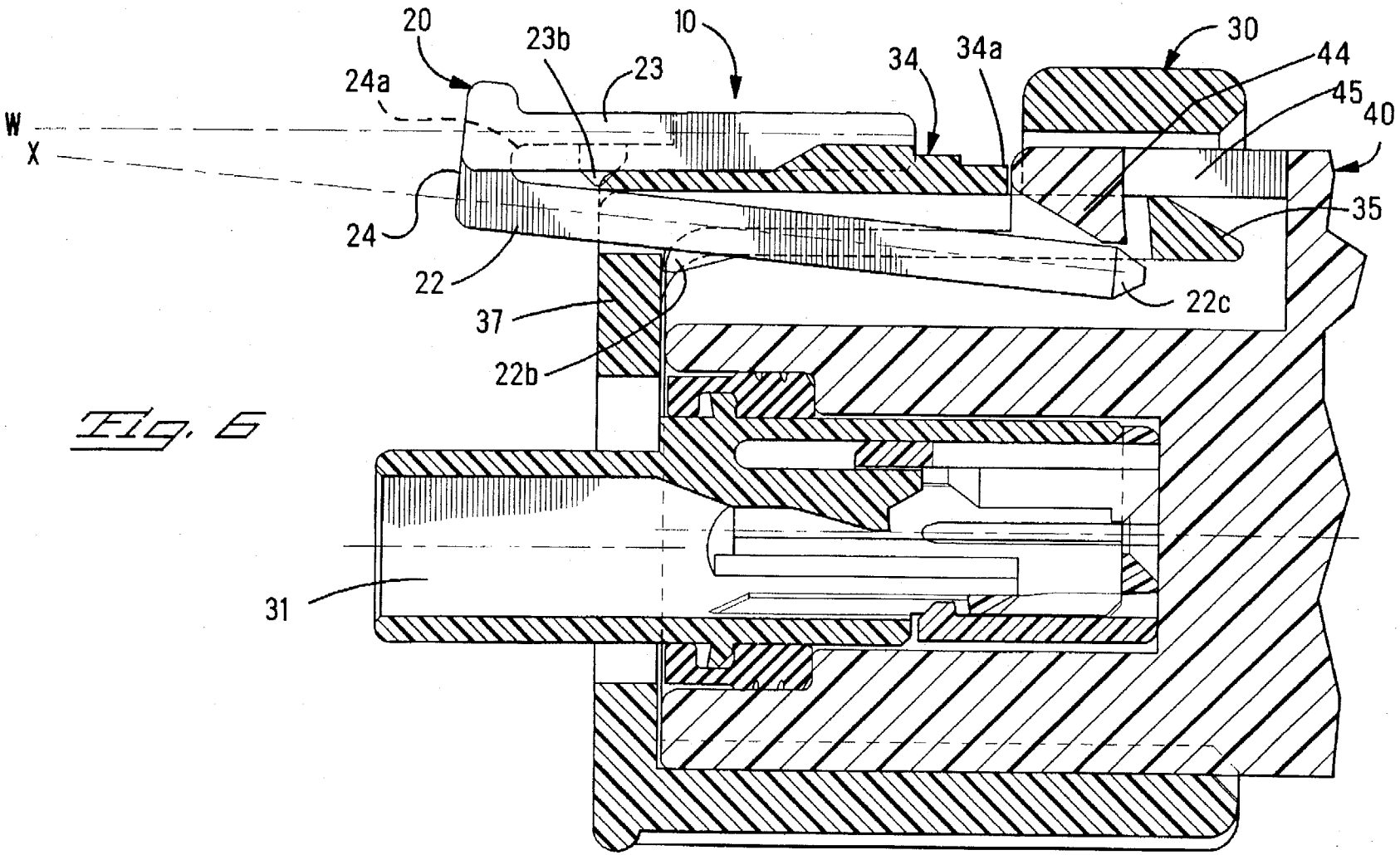
FIG. 6 shows a cross sectional, side elevational view of the plug housing and receptacle housing fully mated together but with the CPA in a pre-latched position.

FIG. 6 shows the plug housing 30 and receptacle housing 40 in a fully mated position. At this point, the CPA 20 can be advanced, however, front section 35 of beam 34 must be disposed in the latch aperture 45 of receptacle housing 40. This happens because the front section 35 will have bent downwardly in response to engagement with tapered rail 44, but it then will resile upwardly again thereby latching the receptacle housing 40 and plug housing 30 together. As shown in FIG. 6, the end section 22*c* of central beam 22 is adjacent to tapered rail 44 of receptacle housing 40. At this point the flat bottoms 23*a* of collateral beams 23 are snugly engaged with runners 33*b* of collateral corner sections 33, and the flexible web 24 of CPA 20 is in a deformed state so that there is an angular difference, or offset, between axis W of collateral beams 23 and axis X of central beam 22. Web 24 advantageously includes the radiused profile 24*a*, which profile has been widened by the flexure of the web material due to the offset of the axes W and X. The radius shape of profile 24*a* prevents a concentration of tensile forces in the CPA 20 web 24 which would otherwise cause stress cracks and splits in the CPA material.

Figure 7:
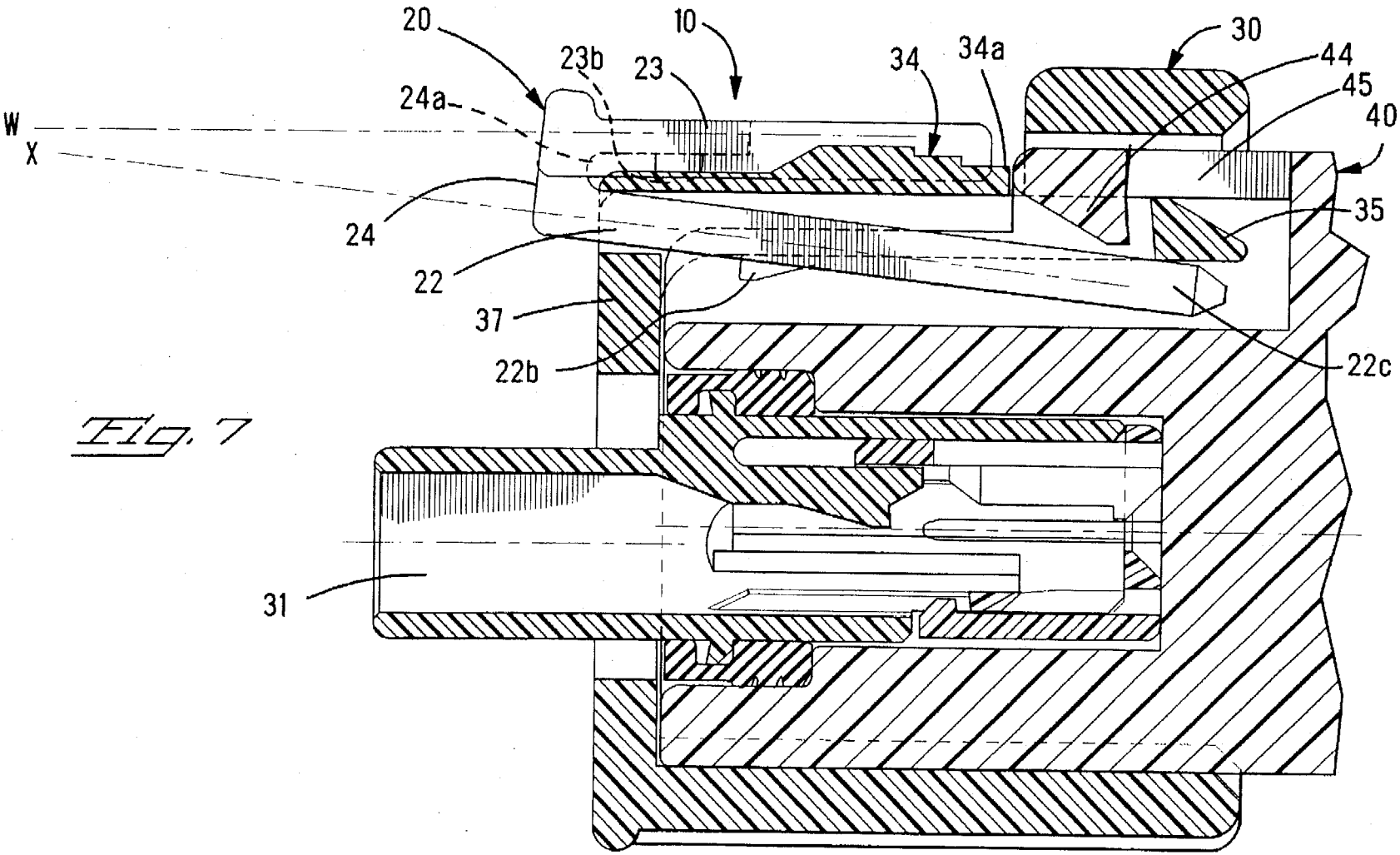
FIG. 7 shows the plug housing and receptacle housing fully mated together but with the CPA in a fully inserted, final latching position.

FIG. 7 shows the electrical connector assembly 10 in a fully mated position with the CPA 20 in a fully advanced state. End section 22*c* of central beam 22 is lodged below front end section 35 of plug housing 30 thereby providing a double locking of the deflectable beam 34. Collateral detents 23*b* of collateral beams 23 are in a latched position behind edges 33*a* of plug housing 30 thereby retaining the CPA 20 in the fully advanced state on electrical connector assembly 10. Additionally, aperture flange 37 of plug housing 30 is in engagement with central beam 22 thereby supporting the beam and wedging the beam in a interference fit between the aperture flange 37 and front section 35 of beam 34.

With respect to materials of construction, it is contemplated that the CPA 20, the plug housing 30, and the receptacle housing 40 will be preferably made of a suitable dielectric material, e.g. a thermoplastic, thermosetting plastic, or elastomeric material. A preferable process for forming the assembly 10 is, for example, an injection molding process. Although the embodiment described above shows three contact apertures 31 in plug housing 30, it is to be understood that the invention can be practiced with more or less contact apertures formed in the plug housing. Additionally, it is contemplated that the CPA of the present invention could be installed on the receptacle housing 40 in its pre-engagement position by modifying the receptacle housing 40 and plug housing 30 accordingly. Thus, while preferred embodiments of the invention have been disclosed, it is to be understood that the invention is not to be strictly limited to such embodiments but may be otherwise variously embodied and practiced within the scope of the appended claims.

Accordingly, what is claimed is:

1. A matable electrical connector half, comprising:

a plug housing with at least one contact receiving aperture therein, said plug housing includes a deflectable housing beam for engaging a further matable connector half and a housing aperture adjacent to said housing beam for receiving a portion of a connector position assurance device (CPA);

a CPA having a primary beam for insertion into said housing aperture, said CPA includes at least one secondary beam for disposition on said plug housing, and said CPA is movable between first and second positions with respect to said housing, said plug housing includes a runner for slidably engaging said secondary beam as said CPA is moved between said first and second positions; and wherein said runner comprises a length of plug housing material which extends between said primary and secondary beams when said CPA is in said first position.

2. The matable connector half of claim 1, wherein said primary beam includes a primary detent for engaging a portion of said plug housing and includes an end section for engaging said housing, thereby trapping said CPA in said first position.

3. The matable connector half of claim 1, wherein said CPA includes a secondary detent for engaging a portion of said plug housing and an end section for engaging said housing, thereby trapping said CPA in said first position.

4. The matable connector half of claim 1, wherein said CPA includes a body portion which extends generally transverse to said primary beam.

5. The matable connector half of claim 1, wherein a body portion of said CPA is connected to said primary beam by a flexible web portion.

6. The matable connector half of claim 5, wherein said flexible web portion comprises an arcuate profile.

7. The matable connector half of claim 1, wherein said secondary beam is located laterally of said primary beam.

8. The matable connector half of claim 1, wherein said primary beam extends further into said plug housing relative to said secondary beam when said CPA is in said first position.

9. The matable connector half of claim 1, wherein a further secondary beam is formed on said CPA.

10. The matable connector half of claim 9, wherein said primary beam is formed between said secondary beams.

11. An electrical connector assembly, comprising:

a plug housing with at least one contact receiving aperture therein, said plug housing includes a deflectable housing beam for engaging a receptacle housing and a housing aperture adjacent to said housing beam for receiving a portion of a connector position assurance device (CPA);

a receptacle housing for matably receiving said plug housing;

a CPA having a primary beam for insertion into said housing aperture, said CPA is movable between first and second positions with respect to said plug housing, and said primary beam comprises a longitudinal axis; and said receptacle housing includes a tapered rail for deflecting said primary beam as said plug and receptacle housings are mated together.

12. The assembly of claim 11, wherein said receptacle housing includes a tapered rail for deflecting said plug housing beam as said plug and receptacle housings are mated together.

13. The assembly of claim 11, wherein said CPA includes a secondary beam disposed adjacent to said primary beam for slidable engagement with said plug housing, and said secondary beam comprises a longitudinal axis.

14. The assembly of claim 13, wherein said primary and secondary beam axes are generally parallel when said CPA is in said first position.

15. The assembly of claim 13, wherein said primary and secondary beam axes become gradually offset as said plug and receptacle housings are mated together.

16. The assembly of claim 11, wherein said CPA includes a body portion, and said primary beam and said body are connected by a flexible web portion.

17. The assembly of claim 16, wherein said flexible web portion undergoes flexing motion as said plug and receptacle housings are mated together.

* * * * *